US007066242B1

(12) United States Patent
Ranville et al.

(10) Patent No.: US 7,066,242 B1
(45) Date of Patent: Jun. 27, 2006

(54) SACRIFICIAL REFRACTORY SHIELD ASSEMBLY FOR USE ON A BOILER TUBE

(76) Inventors: David Ranville, 25750-18 Street, Edmonton, Alberta (CA) T5Y 6B5; Kenneth Ranville, 26750-18 Street, Edmonton, Alberta (CA) T5Y 6B5

( * ) Notice: Subject to any disclaimer, the term of this patent is extended or adjusted under 35 U.S.C. 154(b) by 0 days.

(21) Appl. No.: 11/020,929

(22) Filed: Dec. 23, 2004

(51) Int. Cl.
*F28F 19/00* (2006.01)

(52) U.S. Cl. ..... 165/134.1; 29/890.03

(58) Field of Classification Search ..... 165/134.1; 29/890.03, 890.045, 890.054
See application file for complete search history.

(56) References Cited

U.S. PATENT DOCUMENTS 3,470,678 A 10/1969 Clark et al.
4,071,311 A * 1/1978 Errington ..... 432/234
4,554,967 A 11/1985 Johnson et al.
4,961,761 A 10/1990 Johnson
5,154,648 A * 10/1992 Buckshaw ..... 165/134.1
5,220,957 A * 6/1993 Hance ..... 165/134.1
5,511,609 A * 4/1996 Tyler ..... 165/134.1
6,065,532 A * 5/2000 Brownlee ..... 165/134.1
6,612,366 B1 * 9/2003 Chuang ..... 165/134.1
6,971,169 B1 * 12/2005 Terashima et al. ..... 29/890.046

* cited by examiner

*Primary Examiner*—Teresa J. Walberg
(74) *Attorney, Agent, or Firm*—Sheridan Ross P.C.

(57) ABSTRACT

The refractory shield assembly comprises: a semi-circular, elongate, metal shield; a plurality of spaced apart anchors protruding from the front surface of the shield; a layer of abrasion-resistant refractory material overlying the surface and extending between and engaging the anchors, whereby the refractory material is held on the shield by the anchors; and means, such as clamps, for securing the shield on a boiler tube. The refractory shield assembly functions to protect the underlying boiler tube from erosion by a stream of hot combustion gas containing particulates.

11 Claims, 5 Drawing Sheets

SACRIFICIAL REFRACTORY SHIELD ASSEMBLY FOR USE ON A BOILER TUBE

FIELD OF THE INVENTION

The invention relates to a refractory shield assembly for protecting a component, such as a boiler tube or structural member, from an abrasive erosive gas stream carrying particulates.

BACKGROUND OF THE INVENTION

It is well understood that a boiler operates at high temperatures and components within the boiler must be able to withstand extreme conditions that exist therein.

One such component is a stainless steel boiler tube through which water and/or steam flows.

Hot combustion gases carrying abrasive particulates, such as fly ash, flow over the tubes. The particulates will abrade and erode the tubes. As a result, the tubes will have a short life without protective measures.

It is conventional to protect a boiler tube in the path of the gas stream with a stack of sacrificial "shields". These shields are semi-circular, elongate, stainless steel members that are each secured to the tube by u-shaped clamps that extend around the back of the tube and are welded to the side edges of the shields. It is not uncommon for as many as three shields to be stacked and separately clamped on a boiler tube with the objective of protecting the tube for about a two year or longer period.

It is typical practice to shut down and open the boiler for inspection and maintenance about every 1 to 1½ years. Typically, one will find on the first shut-down that one or two of the shields will have been so eroded that they have fallen off or need to be replaced. This is then done and the boiler is placed back in service. On the second shut-down, all of the shields on the tube are usually removed and a new stack is applied.

During a boiler shut-down, this replacement of the shields can be the operation that determines the length of the shut-down. Removing and replacing the shields involves considerable welding and consumption of welding manpower.

As a consequence, there has long existed a need to develop a better sacrificial shield which has extended durability. It is the objective of this invention to address this need.

SUMMARY OF THE INVENTION

In accordance with the invention, a refractory shield assembly is provided for use in protecting a component, such as a boiler tube, from a gas stream carrying abrasive particulates. In the particular case of a boiler tube, the assembly comprises:

1. an elongate, usually semi-circular, metal sacrificial shield adapted to overlie that portion or length of the boiler tube's outer surface that lies in the path of the gas stream;
2. the shield having a plurality of outwardly protruding, spaced apart "anchors" welded or otherwise secured to that portion of the shield's outer surface facing the gas stream; and
3. the shield further having a layer of an abrasion-resistant refractory material overlying all or part of the shield's outer surface, which layer engages and is held in place by the anchors.

In a preferred feature, the refractory material, which for example may be aluminium oxide silica, has been pretreated, while in place on the shield, by progressively heating it, for example in an oven, to remove moisture with minimal surface cracking of the layer's front face.

In another preferred feature, the refractory material covers only a central strip of the shield's outer surface, so as to leave bare marginal side areas for welding the clamp ends thereto. Yet, in the case of a shield for a tubular component such as a boiler tube, the refractory layer extends through a sufficient arc (say 120°–150°) so as to fully shield or protect the underlying shield from direct contact by the gas stream.

In still another preferred feature, the refractory layer is monolithic in nature. That is, the layer is a single continuous layer.

In still another preferred feature, the shield and layer are configured so as to substantially conform with the outer surface of the component and are dimensioned so as to extend only part way around the component, but they extend sufficiently so as to shield or protect the component from the on-coming gas stream.

In still another preferred feature, the anchors are spot or tack welded at points spaced along their lengths to the shield so as to reduce the likelihood of separation or refractory cracking due to differential thermal expansion and contraction.

From the foregoing it will be understood that the invention involves applying a layer of abrasion-resistant refractory material to a protective sacrificial shield and securing it in place by means of protruding anchors. This concept finds particular application in the case of a boiler tube in the path of erosive gas. However, it is contemplated to be also applicable to other components, such as structural support I-beams, which are also exposed to such gas streams.

The refractory shield assembly lends itself to being fabricated off-site prior to the shut-down and then brought to the boiler in a state ready for securement to the component to be protected.

In one embodiment, a refractory shield assembly is provided for protecting a component, such as a boiler tube, against abrasion and erosion by a stream of hot gas containing particulates, comprising: an elongate metal shield, preferably configured and dimensioned so as to conform with the component, the shield having an outer surface; a plurality of spaced apart anchors attached to the outer surface so as to protrude therefrom; and a layer of an abrasion-resistant refractory material overlying at least part of the shield's outer surface and extending between the anchors, so that the refractory material is secured in place on the shield by the anchors.

In another embodiment, a process is provided for manufacturing a refractory shield assembly for use in protecting a boiler tube from abrasion and erosion by a stream of hot gas containing particulates, comprising: providing a semi-circular, elongate, metal sacrificial shield dimensioned so as to extend only part way around the boiler tube; welding a plurality of outwardly protruding, spaced apart anchors to a portion of the shield's outer surface that will face the gas stream; applying a monolithic layer of refractory material so as to substantially overlie the shield's outer surface, the layer engaging the anchors so as to be secured thereby to the shield; whereby a unitary assembly is produced; and heating the unitary assembly at progressively increasing temperatures to dry the refractory material, prior to installation on the boiler tube.

DESCRIPTION OF THE DRAWINGS

The invention will now be further described by way of examples only and with reference to the following Figures wherein.

DESCRIPTION OF THE PREFERRED EMBODIMENT

Figure 1:
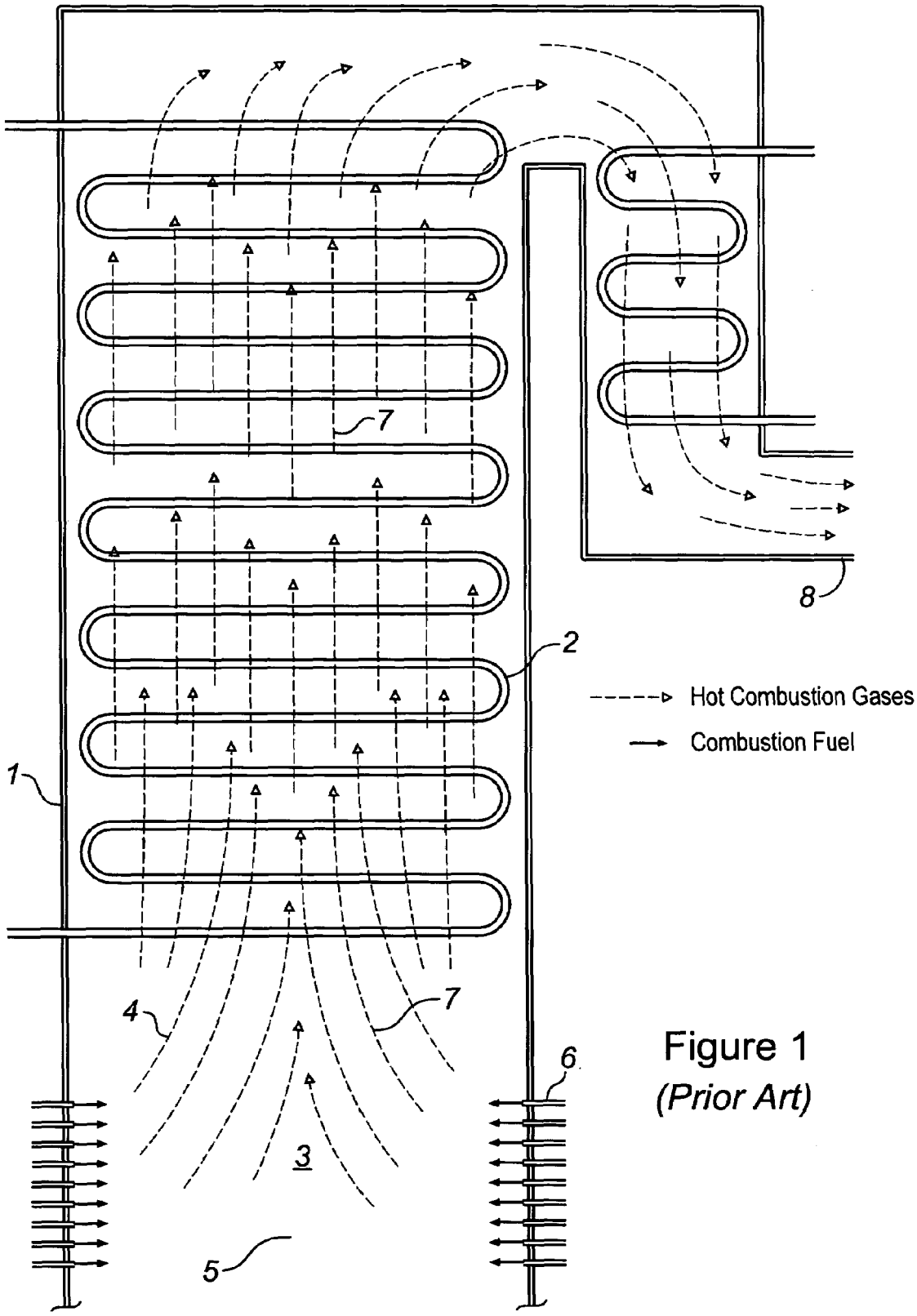
Figure 1 (Prior Art)
FIG. 1 is a schematic, fanciful representation of a boiler showing a boiler tube and a stream of hot combustion gas flowing through the boiler chamber.
Figure 8:
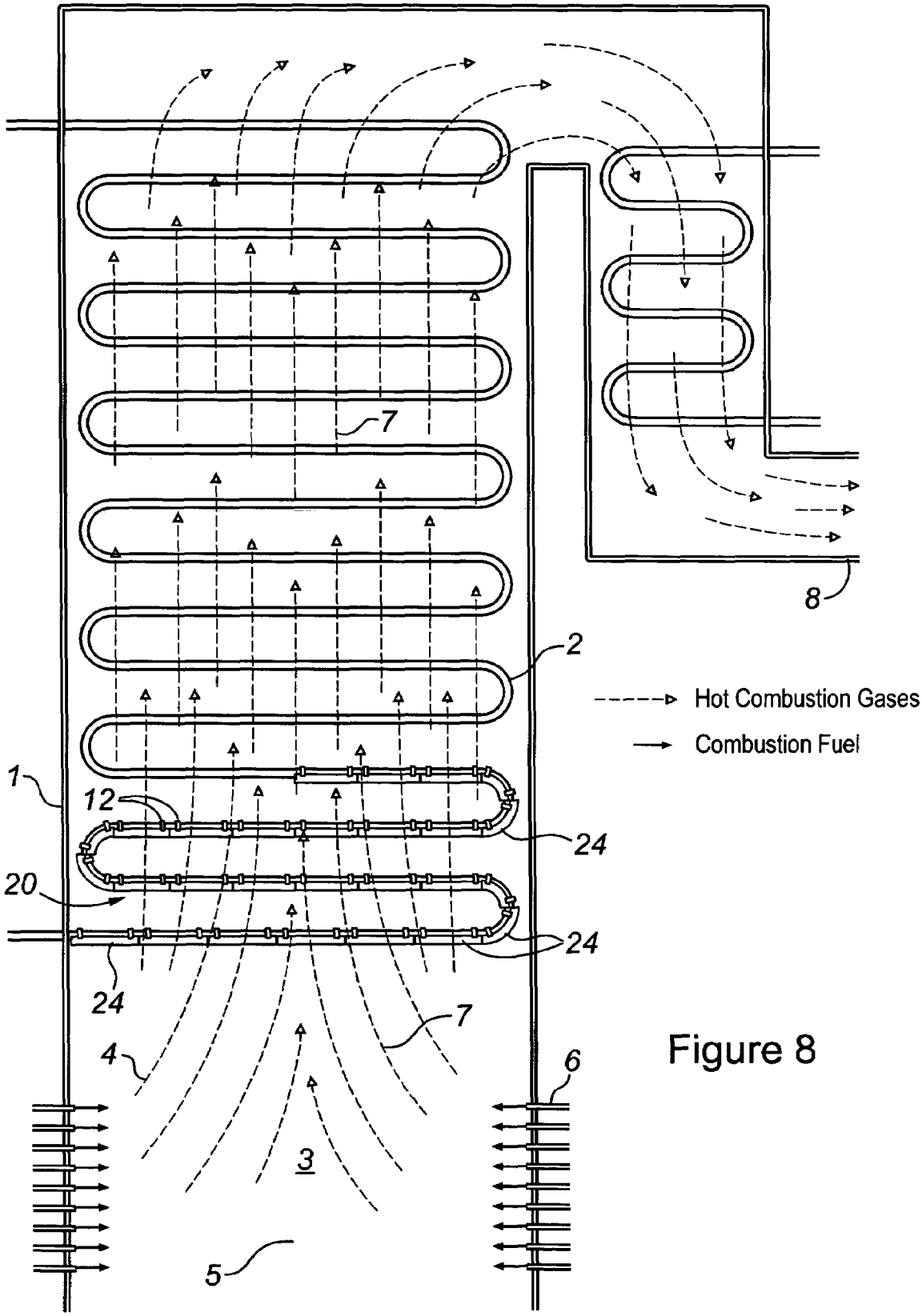
FIG. 8 is a schematic, fanciful representation of a boiler showing a refractory shield assembly of this invention secured to the underside of the boiler tube that is exposed to the stream of combustion gas flowing from below.
Figure 9:
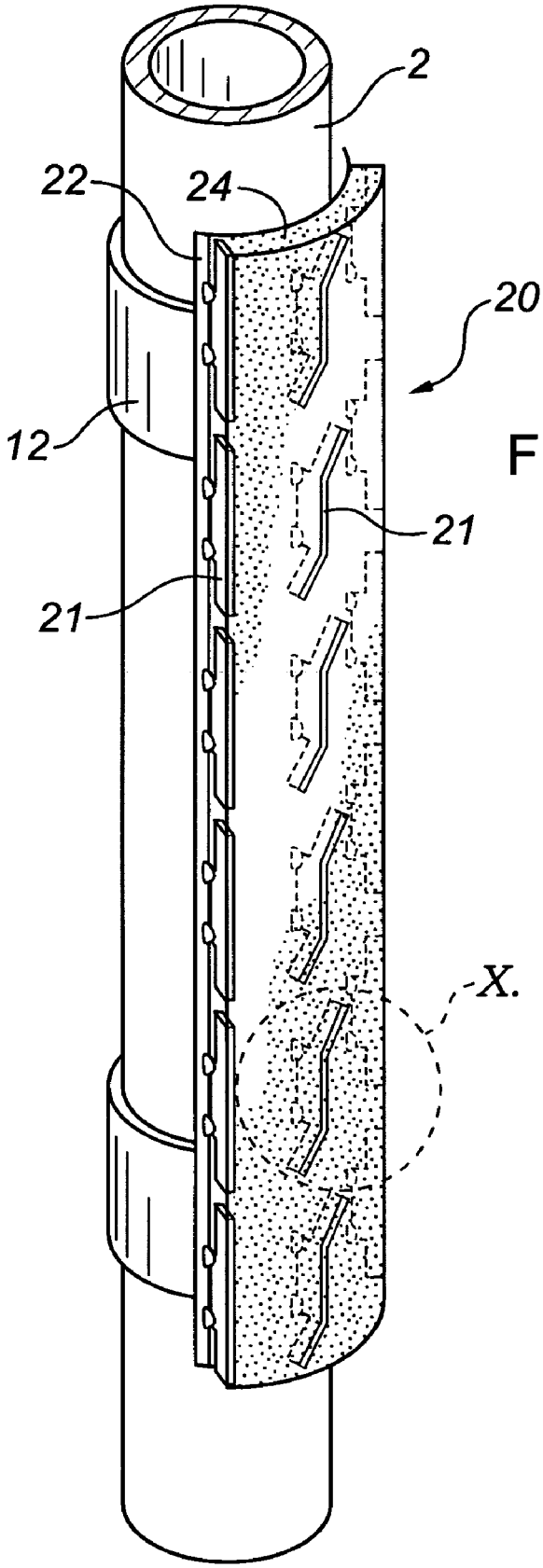
FIG. 9 is a perspective view of a boiler tube having the refractory shield assembly secured thereto by tack welds and showing the refractory material extending between and engaging the anchors.
Figure 10:
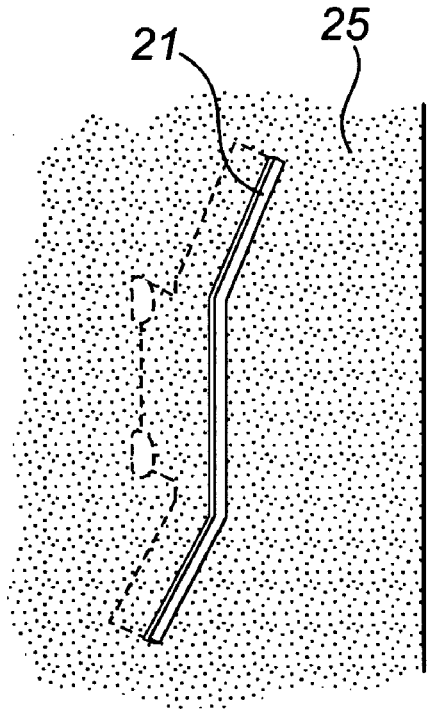
FIG. 10 is a magnified view of the section of FIG. 9 within the circle X.

Having reference to FIGS. 1 and 8, there is shown a fanciful representation of a conventional boiler 1 having a boiler tube 2 mounted within its chamber 3. Hot combustion gas 4, produced by a burner 6 and containing abrasive particulates, such as fly ash, is produced or introduced into the base 5 of the boiler chamber 6. The hot combustion gas flows through the chamber 3 in the form of a stream 7 indicated by the dashed arrows. The stream 7 of hot gas passes over the boiler tube 2 and exits the boiler 1 through an outlet 8.

Figure 2:
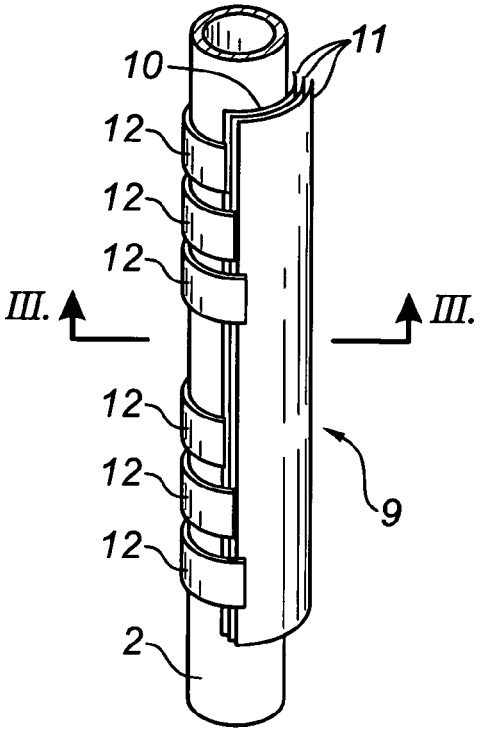
Figure 2 (Prior Art)
FIG. 2 is a perspective view in accordance with the prior art, showing a stack of shields, each clamped to a section of the boiler tube.
Figure 3:
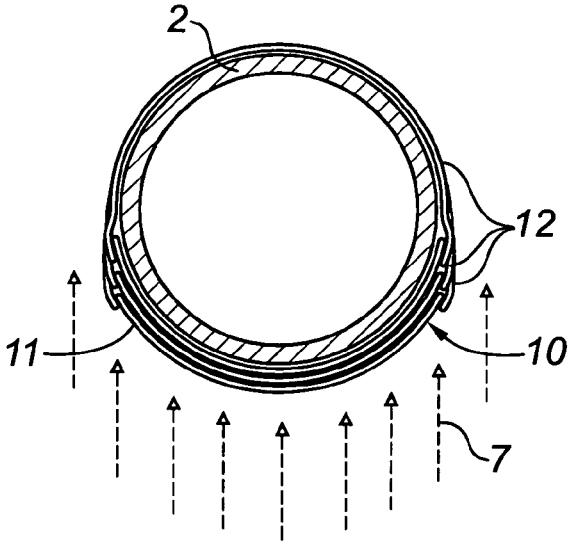
Figure 3 (Prior Art)
FIG. 3 is a transverse sectional view of the assembly of FIG. 2, taken along line A—A of FIG. 2.

FIGS. 2 and 3 show a sacrificial shield assembly 9 in accordance with the prior art. The assembly 9 comprises a stack 10 of semi-circular, elongate, stainless steel shields 11 held in place on the boiler tube 2 by welded clamps 12. The shields 11 are positioned in the path of the gas stream 7, so as to shield or protect the boiler tube 2.

Figure 4:
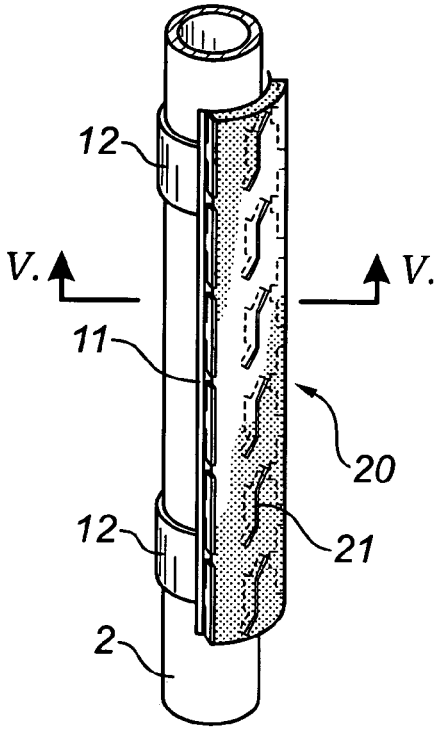
FIG. 4 is a perspective view of a section of boiler tube supporting a refractory shield assembly in accordance with this invention, the assembly comprising a shield, anchors and a layer of overlying abrasion-resistant refractory material.
Figure 5:
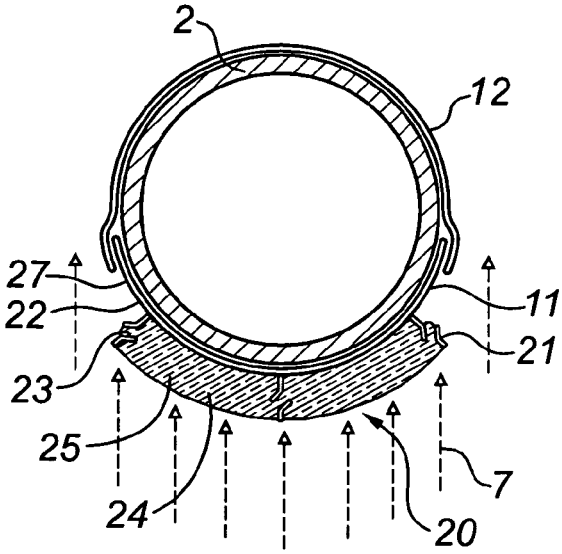
FIG. 5 is a transverse sectional view of a section of boiler tube to which is secured a refractory shield assembly, in which the refractory layer only overlies a central strip of the shield's outer surface which is in the path of the gas stream, the anchors shown engaging the refractory layer.
Figure 7:
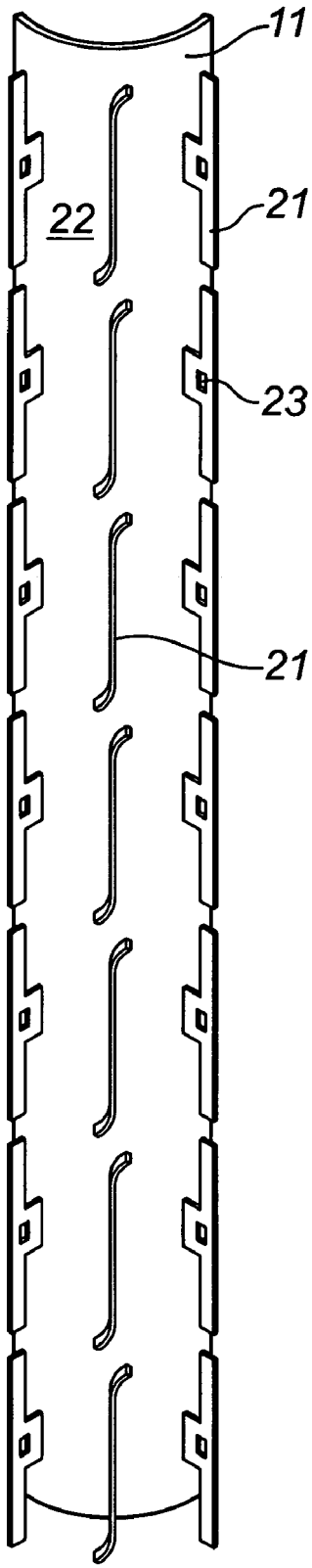
FIG. 7 is a side view of the shield showing a plurality of anchors secured thereto.

Turning now to FIGS. 4 and 5, there is shown a sacrificial refractory shield assembly 20 in accordance with this invention. Some of the parts of the assembly 20 conform or correspond with parts of the assembly 9 and will be referred to by the same numerals.

More particularly, the refractory shield assembly 20 comprises an arched shield 11 having a plurality of spaced apart anchors 21 spot welded or otherwise attached thereto. The anchors 21 protrude outwardly from that portion of the shield's outer surface 22 which faces the oncoming gas stream 7. The anchors 21 may take a variety of configurations, but those shown in the Figures form transverse apertures 23, for a purpose explained below.

It will be noted that the shield 11 extends only part way around the boiler tube 2 but it extends sufficiently so as to overlie substantially all of that portion of the tube 2 that lies in the path of the on-coming gas stream 7, so as to protect it from the erosive gas.

A monolithic layer 24 of abrasion-resistant refractory material 25 overlies all or part of the shield's outer surface 22, as illustrated in FIGS. 4 and 5. The refractory material 25 extends between the anchors 21 and engages them. Preferably it extends through the apertures 23 to better secure the layer 24 to the anchors.

Various abrasion-resistant refractory materials which are commercially available can be used. We have used a so-called "aluminium oxide silica" composition available from Vesuvius USA under the registered trade-mark ACTCHEM.

This material comes in the form of a coarse powder. It is mixed with water to form a thick paste having the consistency of plasticine. The paste is trowelled onto the outer surface 22 of the shield 11 so as to extend between the anchors 21 and to extrude through the apertures 23. The material can then be firmly packed into place. The resulting arcuate layer 24 overlies the shield's outer surface 22 and engages the anchors 21. It is capable of remaining in place on the shield 11 without being bonded to the shield surface 22. The shield 11 and the applied refractory material layer 24 secured in place thereon combine to form a unitary assembly 26.

The refractory material 25 is moist when so applied. If used in the boiler in that state, the water will quickly evaporate and leave cracks in the layer's outer surface 27. These cracks may result in spalling and erosion by the gas flow.

I therefore pre-treat the assembly 26 by heating it progressively in an oven at slowly increasing temperature, to evaporate the contained moisture in a controlled manner, with the objective of drying the material while minimizing cracking, prior to installation on the boiler tube 2.

Figure 6:
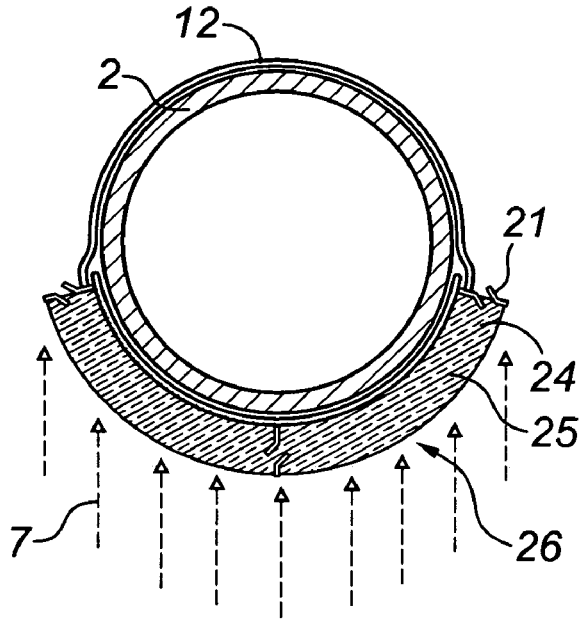
FIG. 6 is a transverse sectional view of a section of boiler tube having an alternative version of the refractory shield assembly secured thereto, showing the layer of refractory material overlying substantially all of that portion of the shield's outer surface that would lie in the path of the oncoming gas stream.

The refractory layer 24 may overlie the entire width of the shield's arcuate outer surface 22, as shown in FIGS. 4 and 6, or only a central strip thereof, as shown in FIG. 5. In the former case, I have found that the refractory shield assembly 20 may unduly restrict the passage of the hot gas stream between adjacent boiler tubes 2. For this reason it is preferable to use the FIG. 5 embodiment, wherein the thick layer 24 extends through an arc of between 120°–150° but still shields the underlying shield's outer surface 22. In addition, the shield 11 is then left with marginal edge portions 27 which are available for welding the semi-circular holding clamps 28 thereto.

As indicated, conventional holding clamps 28 are positioned to extend around the back side of the boiler tube 2 and are welded or otherwise attached to the shield 11, to secure the refractory shield assembly 20 in place on the boiler tube, for the purpose of protecting the boiler tube from abrasion and erosion by the gas stream.

The invention claimed is:

1. In combination:

a boiler tube in a boiler through which passes a stream of hot gas containing particulates; and a refractory shield assembly for protecting the boiler tube with respect to abrasion and erosion by the gas stream, said gas stream being directed at one side of the boiler tube;

the refractory shield assembly comprising:

an arcuate, elongate, metal, sacrificial shield extending part way around said tube so as to overlie the length of the boiler tube that lies in the path of the gas stream, the shield having an outer surface facing the oncoming gas stream;

a plurality of spaced apart anchors attached to the shield's outer surface so as to protrude outwardly therefrom;

a monolithic layer of an abrasion-resistant refractory material overlying sufficient of the shield's outer surface so as to protect the shield from the oncoming gas stream, said layer engaging the anchors so that the refractory material is secured in place on the shield by the anchors; and means for securing the shield to the boiler tube.

2. The combination as set forth in claim 1 wherein each anchor is spot-welded to the shield.

3. The combination as set forth in claim 1 or 2 wherein the refractory material has been applied when moist to the shield to produce a unitary assembly and the unitary assembly has been heated at progressively increasing temperature to dry the material, prior to installation on the boiler tube.

4. The combination as set forth in claim 1 or 2 wherein:

the layer of refractory material overlies a central strip of the shield's outer surface, leaving marginal edge portions bare; and the means for securing the shield to the boiler tube is a plurality of spaced apart, substantially semi-circular clamps welded at their ends to the marginal edge portions.

5. A process for manufacturing a refractory shield assembly for use in protecting a boiler tube from abrasion and erosion by a stream of hot gas containing particulates, comprising:

providing a semi-circular, elongate, metal, sacrificial shield dimensioned so as to extend only part way around the boiler tube;

welding a plurality of outwardly protruding, spaced apart anchors to a portion of the shield's outer surface that will face the gas stream;

applying a monolithic layer of refractory material so as to substantially overlie the shield's outer surface, the layer engaging the anchors so as to be secured thereby to the shield;

whereby a unitary assembly is produced; and heating the unitary assembly at progressively increasing temperature to dry the material, prior to installation on the boiler tube.

6. A refractory shield assembly for protecting a component against abrasion and erosion by a stream of hot gas containing particulates, comprising:

an elongate metal sacrificial shield to be secured to the component, the shield being sized and configured so as to extend only part way around the component and having an outer surface which will face the oncoming gas stream;

a plurality of spaced apart anchors attached to the shield's outer surface so as to protrude outwardly therefrom; and a layer of an abrasion-resistant refractory material overlying sufficient of the shield's outer surface so as to protect the shield from the oncoming gas stream when the assembly is in use on the component, said layer engaging the anchors so that the refractory material is secured in place on the shield by the anchors.

7. A refractory shield assembly as set forth in claim 6 wherein the layer is monolithic.

8. A refractory shield assembly as set forth in claim 6 or 7 wherein each anchor is spot-welded to the shield's outer surface.

9. A refractory shield assembly as set forth in claim 6 or 7 wherein the refractory material has been applied when moist to the shield to produce a unitary assembly and the unitary assembly has been heated at progressively increasing temperature to dry the material, prior to installation on the component.

10. A refractory shield assembly as set forth in claim 6 or 7 wherein each anchor is spot-welded to the shield's outer surface and the refractory material has been applied when moist to the shield to produce a unitary assembly and the unitary assembly has been heated at progressively increasing temperature to dry the material, prior to installation on the component.

11. A refractory shield assembly as set forth in claim 6 or 7 wherein the shield is arcuate in configuration and the layer of refractory material overlies a central strip of the shield's outer surface, leaving marginal edge portions of the shield bare.

* * * * *